US007478665B2

(12) United States Patent
Nishikawa et al.

(10) Patent No.: US 7,478,665 B2
(45) Date of Patent: Jan. 20, 2009

(54) METHOD OF MANUFACTURING MAGNESIUM ALLOY MATERIAL

(75) Inventors: Taichiro Nishikawa, Osaka (JP); Yoshihiro Nakai, Osaka (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 11/447,868

(22) Filed: Jun. 7, 2006

(65) Prior Publication Data

US 2006/0266495 A1 Nov. 30, 2006

Related U.S. Application Data

(62) Division of application No. 11/078,389, filed on Mar. 14, 2005, now abandoned, which is a division of application No. 10/469,428, filed as application No. PCT/JP02/03282 on Apr. 1, 2002, now Pat. No. 6,904,954.

(30) Foreign Application Priority Data

Apr. 9, 2001 (JP) ..... 2001-110128

(51) Int. Cl.
*B22D 11/06* (2006.01)

(52) U.S. Cl. ..... 164/482; 164/433

(58) Field of Classification Search ..... 164/482, 164/433, 475; 420/407
See application file for complete search history.

(56) References Cited

U.S. PATENT DOCUMENTS 2,233,953 A 3/1941 McDonald
3,596,702 A 8/1971 Ward et al.
4,372,369 A * 2/1983 Flemings et al. ..... 164/482
4,444,244 A * 4/1984 Petit ..... 164/429
6,143,097 A 11/2000 Fujita et al.
6,143,371 A 11/2000 Suzuoki et al.
6,818,075 B1 * 11/2004 Park et al. ..... 148/420
6,904,954 B2 * 6/2005 Nishikawa et al. ..... 164/482
2002/0020475 A1 2/2002 Sakamoto et al.

FOREIGN PATENT DOCUMENTS

EP 0 665 299 A1 * 8/1995
EP 0 799 901 A1 * 10/1997
JP 60-213340 A * 10/1985
JP 10-330863 A 12/1998
JP 2000-212607 A 8/2000
JP 2001-294966 10/2001

OTHER PUBLICATIONS

Amorphous Solid, On-line Wikipedia the free encyclopedia; Jun 2, 2007; 4 pp.

International Preliminary Report on Patentability issued in corresponding International Application No. PCT/JP02/03282, mailed Jan. 6, 2004.

* cited by examiner

*Primary Examiner*—Kevin P Kerns
(74) *Attorney, Agent, or Firm*—McDermott Will & Emery LLP

(57) ABSTRACT

In manufacturing a magnesium alloy, continuous casting is performed using a movable mold. A magnesium alloy to be processed by presswork, forging, and the like can be efficiently provided.

13 Claims, 2 Drawing Sheets

METHOD OF MANUFACTURING MAGNESIUM ALLOY MATERIAL

RELATED APPLICATION

This application is a divisional of application Ser. No. 11/078,389 filed Mar. 14, 2005, now abandoned, which is a divisional of application Ser. No. 10/469,428 filed Aug. 28, 2003, now U.S. Pat. No. 6,904,954, which is a 371 of PCT/JP02/03282 filed Apr. 1, 2002.

TECHNICAL FIELD

The present invention relates to magnesium alloys obtained by continuous casting using a movable mold and manufacturing methods thereof, and in particular, provides a magnesium alloy used for press forming, forging, and the like.

BACKGROUND ART

Magnesium alloys have the lowest specific gravity among practical metal materials, and therefore in recent years, they have increasingly been used for casings of portable equipment and raw materials for automobiles requiring more lightweight. As a current practical manufacturing method of the products, casting by injection molding of a magnesium alloy, such as die casting or thixotropic molding, has predominantly been used.

When products are formed from a magnesium alloy by casting such as die casting or thixotropic molding, casting defects, such as wrinkled surfaces and shrinkage cavities, tend to occur because the latent heat of magnesium per unit volume is low. To repair these defects, putty finishing or grinding, for example, may be required, which considerably decreases productivity and results in higher cost and higher price. In addition, since wrinkled surfaces, shrinkage cavities, or the like are liable to occur, thinning of the product is difficult to achieve. Furthermore, since products are manufactured without plastic working from materials produced by casting, there has been a problem in that it is difficult to improve the strength thereof.

Among the proposed methods, there have been methods in which a cast material obtained by semi-continuous casting such as direct-chill casting (hereinafter referred to as DC casting) is hot-extruded into a predetermined shape, and the extruded material is subjected to rolling process or the like to form a thinner sheet metal, from which shaped products are produced by presswork or the like, or the extruded material is directly formed into shaped products by forging or other method. However, in the case where a sheet for presswork or a material for forging is manufactured by semi-continuous casting such as DC casting, the grain size of a material produced by such casting method is large, and hence it is difficult to directly carry out its presswork or forging as it is. Accordingly, the grain size must be fined by reheating and hot extrusion of the material obtained by the semi-continuous casting. Since the above-described working process of hot extrusion of a cast material must be performed, the number of working processes is increased, which results in decreased productivity and high cost. In addition, since a magnesium alloy is an active metal, the extrusion must be performed at an extrusion rate at which sufficient cooling can be attained so that blackening of a surface thereof or burning may not be caused by heat generated due to processing.

Accordingly, there have been problems of an appreciable decrease in productivity, resulting in high cost, and high price. Additionally, a drawback of a hot extruded material is that it is difficult to process into a complicated shape since the grain size thereof is not sufficiently fine to form a complicated shape.

DISCLOSURE OF INVENTION

The present invention was made in order to solve the problems described above. The present invention is directed to a magnesium alloy obtained by continuous casting using a movable mold and which is a material suitable for efficiently processing by presswork or forging, and to a manufacturing method of the same.

The magnesium alloy of the present invention is obtained by continuous casting using a movable mold, and contains 0.05 to 5 wt % of calcium (Ca), or 0.1 to 10 wt % of aluminum (Al), or 0.05 to 5 wt % Ca and 0.1 to 10 wt % of Al.

According to one embodiment of the present invention, at least one of the surfaces brought into contact with a molten metal in the movable mold forms a closed-loop with respect to a traveling direction of a cast material such that the continuous casting is performed. According to one embodiment, at least one surface of the movable mold is in the form of a belt, or a wheel.

The cooling rate of the cast material is 1° C./sec or more. In the continuous casting, the casting rate is 0.5 m/min or more.

The minimum axis of a cast section of the cast material obtained by continuous casting is 60 mm or less. The rate of variation in cooling rate in the section of the cast material is 200% or less. In this case, the rate of variation in cooling rate is the rate of variation in cooling rate at locations on the same section and the rate of variation in cooling rate at locations in the lengthwise direction, through solidification in the continuous casting process.

The continuous casting using the movable mold is a twin-belt process, a wheel-belt process, or a twin-roll process. Furthermore, a material for the movable mold which is brought into contact with a magnesium molten metal is Fe, Fe-alloy, Cu, or Cu-alloy.

Hereinafter, embodiments of the present invention will be described. FIG. 1 is a typical chart showing a continuous casting apparatus using a movable mold for obtaining the magnesium alloy of the present invention. A molten magnesium alloy smelted in a smelting furnace is fed through a launder to a tundish or the like, which is placed in front of a casting machine, to control the flow quantity, and the molten metal is poured from a casting point 1 to a movable mold formed of a casting wheel 2 which is a wheel mold and a belt 5, so that casting is performed. A long cast material 3 is obtained. In this case, the belt 5 is brought into contact with the casting wheel 2 by a supporting wheel 4, and the state of such contact is adjusted by a tension wheel 6.

The configuration of the movable mold is such that at least one of the surfaces brought into contact with a molten metal preferably forms a closed-loop, such as a belt or a wheel. The reasons the movable mold has a closed-loop is that the solidification surface of the molten metal can be kept constantly smooth and the cooling rate for solidification can easily be kept constant by synchronizing the control of the flow volume of the molten magnesium alloy and that of the traveling rate thereof in accordance with the sectional area of the movable mold. In this embodiment, the movable mold may have at least one surface in the form of a belt, a wheel, the combination thereof, or any other form having the same effects as described above.

The reasons at least one surface of the movable mold is in the form of a belt or a wheel are that a closed-loop with respect to the traveling direction of the cast material can most easily be formed with them and that the maintenance thereof can easily be performed. Furthermore, when the belt or the wheel is used, the surface brought into contact with a molten metal can be continuous, and hence the surface condition of the cast material can be made smooth.

This manufacturing method in which the casting is performed as described above may be said to have high productivity since a long cast material having an endless length can be obtained in principle. In addition, since the casting is continuously performed, the quality of the cast material becomes homogeneous and superior in the lengthwise direction, which results in a suitable material for presswork and forging.

Since a magnesium alloy is a very active metal, it has a tendency to burn by reaction with oxygen in the air, and therefore shielding for prevention of burning is preferably formed with an $SF_6$ gas or the like during smelting. When the gas concentration of the $SF_6$ is 0.10 to 10% by volume and the balance is air, a protective effect against burn can be obtained.

When the shielding by using a gas, such as $SF_6$, for prevention against burning is not performed, burning can be prevented by adding 0.05 to 5 wt % of Ca to the magnesium alloy. In this case, the content of Ca is set to 0.05 to 5 wt % because the preventive effect against burning cannot be obtained if the content is less than 0.05 wt %, and also because cracking occurs during casting and a good cast material cannot be obtained if the content is more than 5 wt %.

By adding Ca, blackening or the like on the surface of a cast material, which is caused by partial oxidation, does not occur. Hence a cast material having superior surface qualities can be obtained. This is believed to be due to the surface of the molten metal being protected by calcium-oxide during casting.

The cooling rate in continuous casting is preferably 1° C./sec or more. The reason for this is that when the cooling rate is less than this, the formed crystal grains of the cast material are coarse, and as a result, a good cast material cannot be obtained. In order to make the crystal grain size smaller, a cooling rate of 10° C./sec or more is preferable.

The casting rate is preferably 0.5 m/min or more. This is because when the casting rate is less than this, the cooling rate decelerates causing the formation of coarse crystal grains of the cast material, and also productivity is decreased.

In addition, in order to improve the workability of presswork or forging, for forming articles, it is essential that the formed crystal grains have a substantially uniform diameter. For this purpose, first, the minimum axis of the section of the cast material is preferably 60 mm or less. When the minimum axis is more than 60 mm, the formation of irregular crystal grains occurs because there is a large difference in the cooling rate between the center and surface portions in a transverse section of the cast material, the cooling rate at the central portion becoming slow. Furthermore, the rate of variation in cooling rate is preferably set to 200% or less. This is because, the uniformity of the crystal grain diameter is improved by decreasing the differences of the cooling rates on the same section in addition to increasing the cooling rate, while the uniformity of the crystal grain diameter is degraded if the rate of variation in cooling rate is more than 200%.

In order to increase the cooling rate as well as the durability, Fe, Fe-alloy, Cu, or Cu-alloy is preferably used as a material for the casting wheel or the belt.

The temperature of the launder is preferably maintained at 200 to 900° C. When the temperature is less than 200° C., the temperature of the molten metal is excessively decreased to degrade the fluidity, and when the temperature is more than 900° C., the molten metal may burn in some cases notwithstanding that shielding is applied using a gas for the prevention of burning, or that Ca is added as described above.

In addition, a holding furnace for temporarily holding a molten metal may be provided between a smelting furnace and a casting machine. In addition to the tundish used for flow quantity control, a more uniform casting rate can be obtained by controlling a certain amount of flow quantity using the holding furnace.

In addition, it is preferable that 0.1 to 10 wt % of Al be added to magnesium, to improve the fluidity of the molten magnesium alloy. When the amount is less than 0.1 wt %, the effect cannot be achieved, and when the amount is more than 10 wt %, a good cast material cannot be obtained since cracking occurs in casting.

The same advantage as described above can be obtained by a magnesium alloy containing 0.1 to 10 wt % of Al and 0.05 to 5 wt % of Ca.

Preferably, the magnesium alloy thus obtained by continuous casting using the movable mold is subjected to homogenization process for 0.5 to 24 hours at 300 to 500° C. subsequent to casting so that it becomes a material suitable for presswork or forging. By the homogenization described above, the occurrence of segregation in casting can be avoided, and hence the workability is improved. Furthermore, after casting, a process such as rolling may be performed for obtaining a predetermined shape. When the process is performed at a temperature of 200 to 500° C., the workability is improved.

In order to improve the strength, elongation, high temperature strength, corrosion resistance, and the like of an article in its final shape, elements, such as zinc (Zn), manganese (Mn), silicon (Si), copper (Cu), silver (Ag), yttrium (Y), and zirconium (Zr), may be added. The content of the addition is preferably 20 wt % or less in total. When the content exceeds this amount, cracking or the like may occur in casting.

BEST MODE FOR CARRYING OUT THE INVENTION

Embodiments

Hereinafter, the present invention will be described in detail with reference to examples.

By using a continuous casting apparatus provided with a movable mold (belt-wheel type) shown in FIG. 1, an alloy shown in the Table was melted at 700 to 800° C., and fed into a tundish through a launder heated to 700° C., and was cast in the movable mold having a cast section of 300 $mm^2$ (height: 10 mm, width: 30 mm), where casting was performed at a rate of lm/min. The cooling rate of the cast material in this case was 50 to 100° C./sec, and the variation rate of the cooling rate in a cross-sectional plane of the cast material was approximately 100%. FIG. 2, shows a cross-section of a part of casting mechanism for the magnesium alloy. The material of the casting wheel 2 and belt 5 is stainless steel (SUS430). Casting is performed in a casting part 7.

Smelting and casting were carried out in a mixed-gas atmosphere composed of air and 0.2 volume percent of an $SF_6$ gas. When this gas for the prevention of burning was not present, a large amount of an oxide was mixed into the cast material. When the alloys of examples 3, 4, and 5 were cast in the state in which the gas for the prevention of burning was not present, cast materials containing no oxide were obtained.

As FIGS. 3 and 4 show the exterior appearances of the cast materials of examples 1 and 5 respectively, blackening due to partial oxidation was observed on the surface of the respective cast materials obtained in examples 1 and 2 and comparative example 6, in which Ca was not added. On the other hand, metallic gloss was recognized on the surface of each of the cast materials obtained in examples 3 and 4, in which Ca was added.

The cast materials thus obtained were each processed by hot rolling at a temperature of 400° C. to form a sheet having a thickness of 1.0 mm, and the sheet was processed by press-work. The sheets thus formed each had superior workability due to their small breakage rate in processing as compared to those obtained by hot-extruding and hot-rolling the cast materials produced by semi-continuous casting such as direct-chill casting.

TABLE

| | No. | Alloy composition | Manufacturing method |
|---|---|---|---|
| Example of present invention | 1 | Mg—3%Al—1%Zn—0.7%Mn | Continuous casting |
| | 2 | Mg—2%Al | |
| | 3 | Mg—0.5%Ca | |
| | 4 | Mg—1.0%Ca | |
| | 5 | Mg—3%Al—1%Zn—0.7%Mn—0.1%Ca | |
| Comparative example | 6 | Mg—3%Al—1%Zn—0.7%Mn | Semi-continuous casting |

INDUSTRIAL APPLICABILITY

Figure 1:
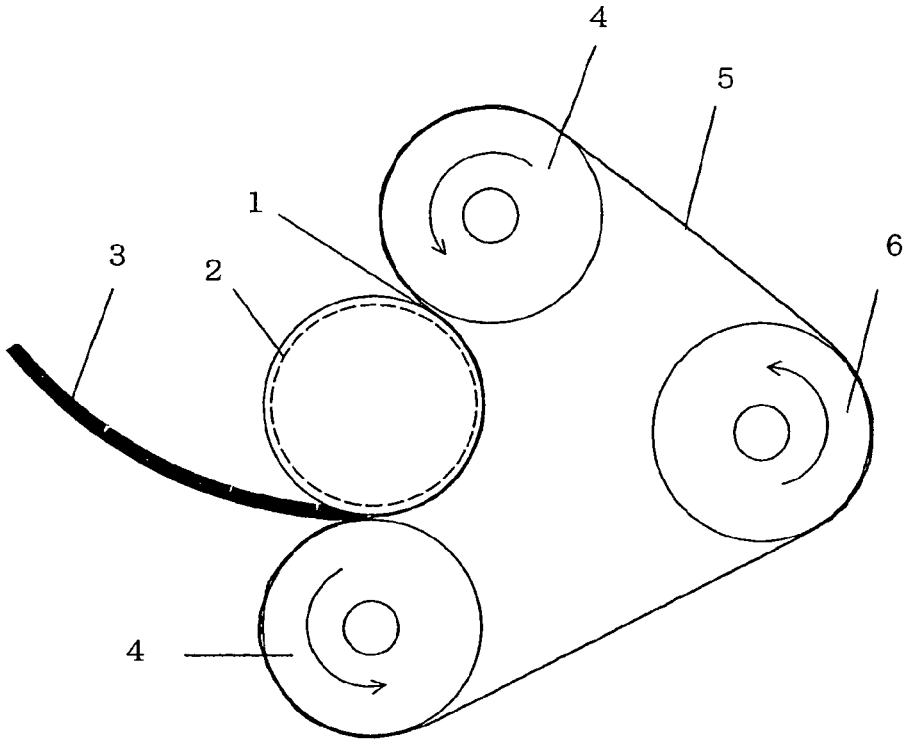
FIG. 1 is a typical chart showing a continuous casting apparatus provided with a movable mold for a magnesium alloy.
Figure 2:
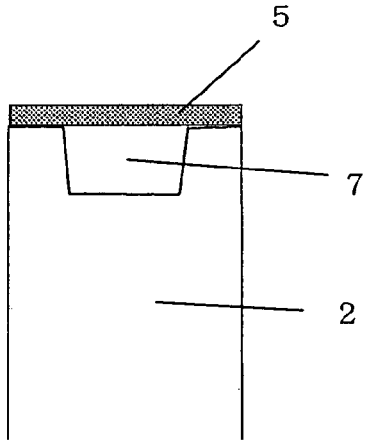
FIG. 2 is a view showing a cross-section of a part of casting mechanism for a magnesium alloy.
Figure 3:
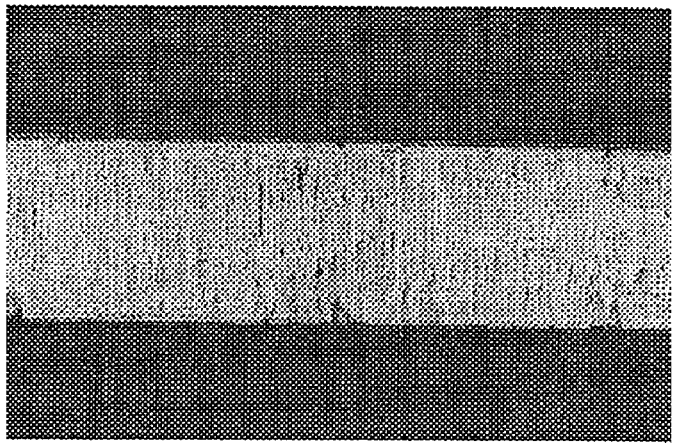
FIG. 3 shows the appearance of a cast material in example 1.
Figure 4:
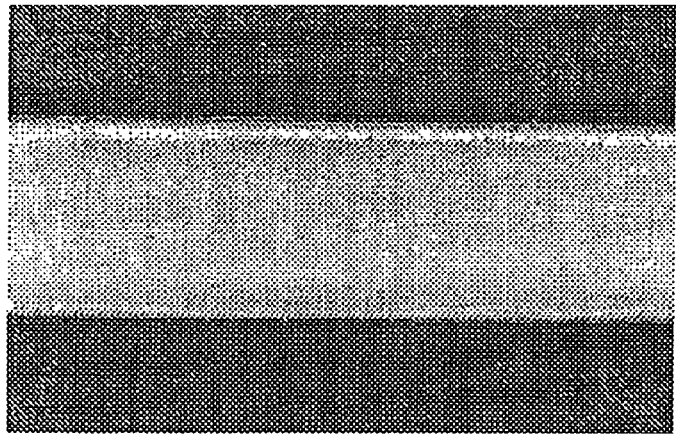
FIG. 4 shows the appearance of a cast material in example 5.

As has been described, a magnesium alloy obtained by continuous casting using a movable mold, according to the present invention, can be efficiently manufactured to have properties equivalent to those obtained by conventional continuous casting, and in addition, when articles are made from the magnesium alloy by pressing or forging, efficient production can be achieved as compared to those manufactured by die casting or thixotropic molding.

The invention claimed is:

1. A method of manufacturing a crystalline magnesium alloy plate, comprising the steps of:

melting raw materials into liquid metal, wherein the liquid metal contains no solids;

molding the liquid metal using a movable mold with a continuous mold structure;

casting at a casting rate of 0.5 meters/minute or more; and cooling the liquid metal into the crystalline magnesium alloy plate;

wherein the thickness of the crystalline magnesium alloy plate is not less than 1 mm, and not more than 60 mm, and the width of the plate is larger than the thickness of the plate, and the cooling step has a cooling rate of at least 50 degrees Celsius per second, and not more than 100 degrees Celsius per second.

2. The method of claim 1, wherein the movable mold has a closed-loop structure.

3. The method of claim 2, wherein the closed-loop structure is a wheel-belt.

4. The method of claim 2, wherein the closed loop structure is a twin-roll.

5. The method of claim 1, further comprising a step of plastically deforming the crystalline magnesium alloy plate.

6. The method of claim 5, wherein the step of plastically deforming comprises hot rolling.

7. The method of claim 6, wherein the hot rolling is performed at approximately 400 degrees Celsius, and wherein the hot rolling forms a sheet approximately 1 mm thick.

8. The method of claim 1, wherein the crystalline magnesium alloy plate comprises not less than 0.1% and not more than 10% Aluminum by weight.

9. The method of claim 8, wherein the crystalline magnesium alloy plate further comprises at least one of the following special elements: Zinc (Zn), Manganese (Mn), Silicon (Si), Copper (Cu), Silver (Ag), Yttrium (Y), and Zirconium (Zr).

10. The method of claim 9, wherein the crystalline magnesium alloy plate comprises not more than 20% by weight of special elements.

11. The method of claim 8, wherein the crystalline magnesium alloy plate further comprises at least one of the following special elements: Zinc (Zn) and Manganese (Mn).

12. The method of claim 11, wherein the crystalline magnesium alloy plate comprises not more than 20% by weight of special elements.

13. The method of claim 1, further comprising homogenizing the liquid metal.

* * * * *